United States Patent [19]

Ruscheweyh

[11] Patent Number: 4,527,903

[45] **Date of Patent: * Jul. 9, 1985**

[54] APPARATUS FOR UNIFORMIZING THE PARAMETERS OF A FLOW AND/OR FOR MIXING TOGETHER AT LEAST TWO INDIVIDUAL STREAMS WHICH DISCHARGE INTO A MAIN FLOW

[75] Inventor: Hans Ruscheweyh, Aachen, Fed. Rep. of Germany

[73] Assignee: Balcke-Dürr Aktiengsellschaft, Ratingen, Fed. Rep. of Germany

[ * ] Notice: The portion of the term of this patent subsequent to Feb. 12, 2002 has been disclaimed.

[21] Appl. No.: 400,211

[22] Filed: Jul. 21, 1982

Related U.S. Application Data

[63] Continuation of Ser. No. 132,477, Mar. 19, 1980, abandoned.

[30] Foreign Application Priority Data

Mar. 26, 1979 [DE] Fed. Rep. of Germany ..... 2911873

[51] Int. Cl.[3] ..... B01F 5/06

[52] U.S. Cl. ..... 366/337; 138/38; 165/109 R; 261/109

[58] Field of Search ..... 366/9, 336, 337, 338, 366/339, 340, 341; 137/896, 897, 898; 48/180 B, 180 C, 180 R; 138/38, 42; 417/151; 239/590.5; 261/DIG. 11, DIG. 77, 105, 109, 112; 98/38 R, 38 A, 38 B, 38 C

[56] References Cited

U.S. PATENT DOCUMENTS

| | | | |
|---|---|---|---|
| 829,127 | 8/1906 | Strauss | 366/9 |
| 1,312,147 | 8/1919 | Wallwin | 48/180 |
| 3,190,618 | 6/1965 | Katzen | 366/337 |
| 3,275,304 | 9/1966 | Brundrett | 366/337 |
| 3,528,614 | 9/1970 | Honmann | 239/590.5 |
| 3,671,208 | 6/1972 | Medsker | 366/173 |
| 3,846,519 | 11/1974 | Spangemacher | 261/DIG. 77 |
| 3,944,636 | 3/1976 | Schulenberg | 165/DIG. 1 |
| 4,022,853 | 5/1977 | Schulenberg | 165/DIG. 1 |
| 4,026,527 | 5/1977 | Costen | 366/165 |
| 4,061,476 | 12/1977 | Holter | 55/99 |
| 4,098,854 | 7/1978 | Knirsch | 165/DIG. 1 |

FOREIGN PATENT DOCUMENTS

| | | | |
|---|---|---|---|
| 1159396 | 12/1963 | Fed. Rep. of Germany | 366/337 |
| 2417076 | 10/1974 | Fed. Rep. of Germany | 261/DIG. 77 |
| 2508123 | 2/1975 | Fed. Rep. of Germany . | |
| 2360059 | 2/1978 | France | 261/109 |
| 418320 | 10/1934 | United Kingdom . | |
| 520574 | 4/1940 | United Kingdom . | |
| 869638 | 6/1961 | United Kingdom . | |
| 1268169 | 3/1972 | United Kingdom . | |
| 1486876 | 9/1977 | United Kingdom . | |
| 663593 | 5/1979 | U.S.S.R. | 366/337 |

*Primary Examiner*—Robert W. Jenkins
*Attorney, Agent, or Firm*—Martin A. Farber

[57] ABSTRACT

An apparatus for uniformizing the parameters of flow and/or for mixing at least two individual streams which discharge into a main flow, as in cooling towers with natural draft and/or with forced ventilation, with stacks or in pipeline systems. At least one element is provided having an upstream edge initiating vortexes which uniformize the parameters of flow and/or mix the streams. The course of the edge of the element defines a component extending in the main direction of flow and a component extending in a direction transverse to the main flow direction. The surface of the element is set at an acute angle with respect to the direction of the main flow. The edge of the element is symmetrical having a plane of symmetry extending in the direction of the main flow.

15 Claims, 16 Drawing Figures

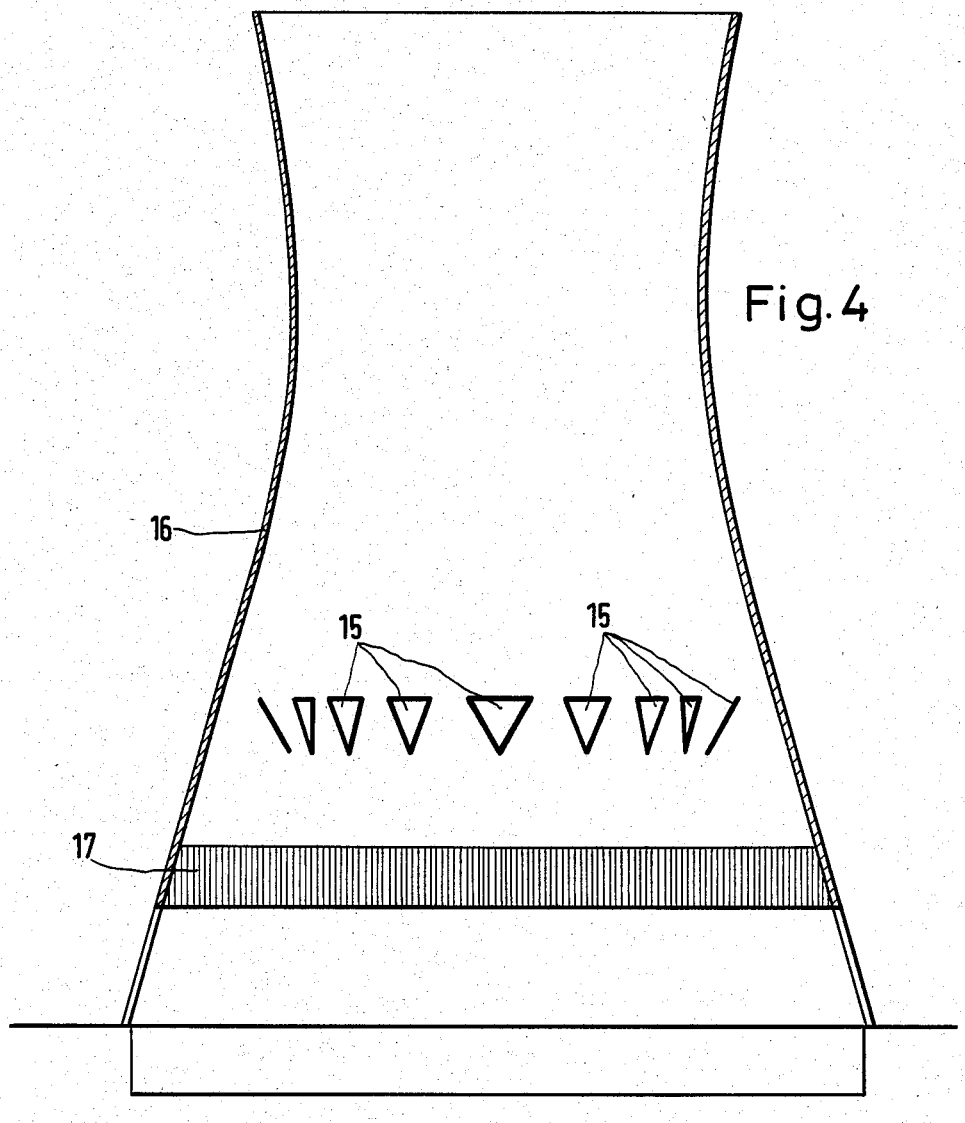
Fig. 4
Fig.5
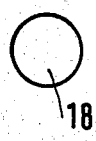
Fig.6
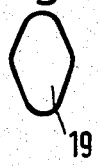
Fig.7
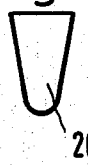
Fig.8
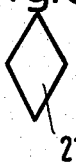
Fig.9
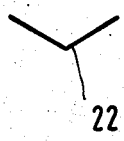
Fig.10
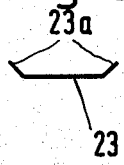

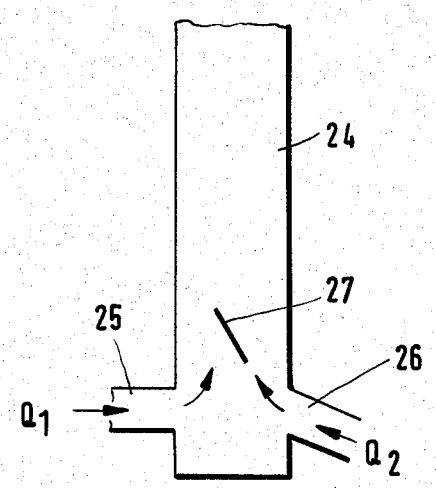
Fig.11
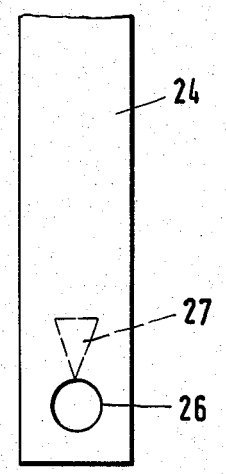
Fig.12
Fig.13
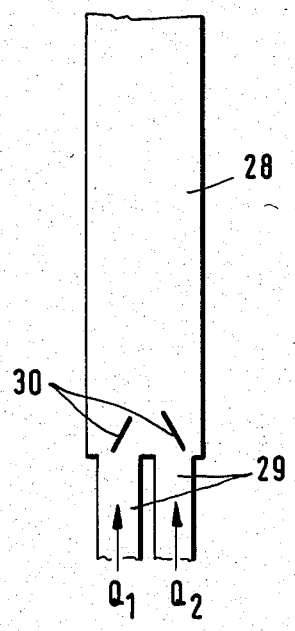
Fig.14
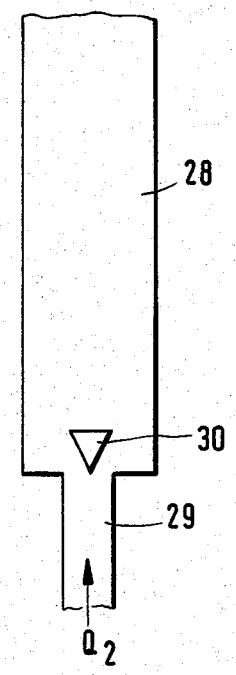

Fig.15
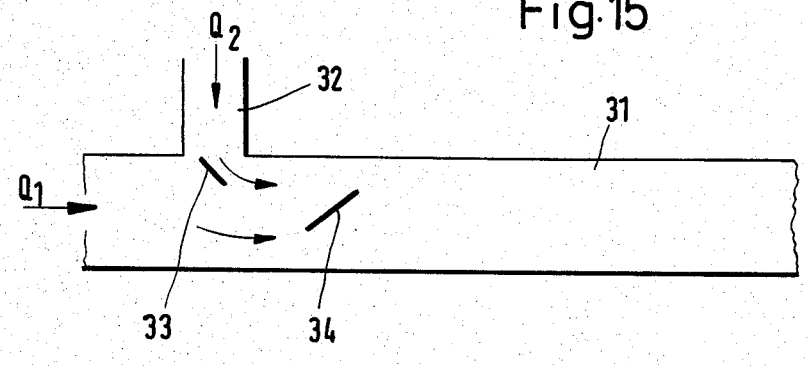
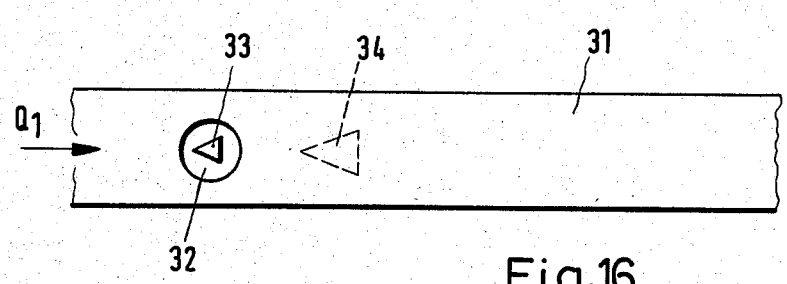
Fig.16

APPARATUS FOR UNIFORMIZING THE PARAMETERS OF A FLOW AND/OR FOR MIXING TOGETHER AT LEAST TWO INDIVIDUAL STREAMS WHICH DISCHARGE INTO A MAIN FLOW

This is a continuation of application Ser. No. 132,477, filed Mar. 19, 1980, now abandoned.

The present invention relates to an apparatus for uniformizing the parameters of a flow and/or for mixing together at least two individual streams which discharge into a main flow, and is intended in particular for cooling towers, stacks and pipeline systems.

The starting point for the invention is cooling towers, which are known in many embodiments both with respect to the manner of obtaining the draft and with respect to the number and arrangement of the heat exchange means. Finally, the known cooling towers differ in the formation of their base surface and in their cross section in the direction of flow of the cooling air.

All known embodiments have in common the problem of the danger of a reduction in output as a result of the varying operating conditions. This reduction in output can result on the one hand from a change in the temperature, density and/or velocity of the surrounding air, a strong crosswind being in particular very detrimental. A reduction in output can also take place due to a change of the conditions in the heat-exchange means, resulting from the operation of the plant, so that, as a function of the amount of heat exchanged, not only does the draft in the cooling tower experience a change, but that non-uniform profiles of the temperature, density, and possibly of the moisture content of the cooling air leaving the heat exchanger units over the cross section of the cooling tower result.

This large number of factors, some of which cannot be influenced and some of which result necessarily from the operation, leads under special conditions to reductions in output even in cooling towers which have profiles of balanced radial symmetry of the physical variables of the streams of cooling air within a relatively large range of output.

A similar problem exists also in stacks, particularly stacks for the removal of flue gasses. Here it is necessary both to obtain a uniform distribution of the particles of soot or other impurities in the stream of flue gas and to obtain, upon the coming together of several individual streams, a good mixing of these individual streams, for instance if the individual streams have different temperatures and/or if one of the individual streams contains a particularly high proportion of noxious substances, for instance sulfur. Finally, the same problem also arises in the case of pipeline systems if positively guided individual streams are to be mixed over a short path with each other with the smallest possible losses.

The object of the invention is accordingly to provide a device for uniformizing the parameters of a flow and/or for mixing at least two partial streams discharging into a main flow, which produces at slight technical cost within a short flow path a low-loss uniformizing or mixing and can be employed in particular in cooling towers, stacks and pipeline systems.

The solution for this problem provided by the invention is characterized by at least one eddy insert surface (this term referring to a vortex generating element), the upstream free edges extending transversely inclined with respect to the main direction of flow and the surface of which is disposed at an acute angle to the direction of the main flow.

On each of the side edges of the eddy insert surface of the invention there is produced an eddy field which spreads out in a circular cone downstream and by its rotation forms a flow component which is transverse to the main direction of flow and by the exchange of momentum inherent there, transverse to the main direction of flow, leads to a good uniformizing of the parameters of a flow or to a good mixing of at least two partial streams discharging into the main flow. This uniformizing or mixing has the result that the profiles of the physical variables of a flow are made uniform.

The eddy insert surface of the invention, however, not only forms very extensive and stable eddies but has a relatively low resistance to flow. This is due to the fact that the flow cross section is reduced in the direction of flow only by the projection of the eddy insert surface which projection is dependent upon the angle of attack, so that the eddy insert surface of the invention has a low degree of obstruction. Since the eddying is effected by the entire length of the edges of the eddy insert surface and continues beyond same, the intensity of the uniformizing or mixing is not detrimentally affected by the low degree of obstruction. As a whole, with the eddy insert surface of the invention there is obtained a low-loss effective uniformizing and mixing which take place within a short path, this effect being obtained by simple parts which are economical to manufacture and can be produced, depending on the operating conditions, from a large number of materials, for instance sheet metal, plastic or asbestos.

In accordance with another feature of the invention, the eddy insert surface has a symmetrical course of its edges with the plane of symmetry extending in the direction of flow of the cooling air. The eddy insert surface can thus be developed in accordance with the invention, for instance, with a circular, elliptical, parabolic or diamond base shape.

One particularly effective development of the eddy insert surface is obtained when it is developed, in accordance with another feature of the invention, in delta shape with vertex directed opposite to the direction of flow of the cooling air since the linear edge course of the side edges and of the base which extends at right angles to the longitudinal direction of the delta-shaped eddy insert surface results in a particularly intensive development of the eddy field with eddies which spread out in the shape of a circular cone downstream and rotate in opposite direction to each other.

Since the low-loss effective mixing is active within short paths, the eddy insert surfaces of the invention are particularly well suited for insertion in cooling towers in which two or more different exhaust air streams are to be mixed, as is true, for instance, in wet-dry cooling towers in order to avoid the formation of vapors. The invention, however, is not limited merely to the mixing of at least two different streams of cooling air but can also be employed if a single stream of cooling air is to be made uniform with respect to its parameters. This is true not only when the moisture content of a flow within a cooling tower differs with respect to the cross section of the flow but also when the difference consists in the temperature and/or velocity and/or chemical composition.

For the mixing of at least two partial streams discharging into a main flow, as a further development of the invention at least one eddy insert surface in accordance with the invention is arranged in the region where the different air streams come together, in the vicinity of the boundary flow surface. The position of the angle of attack of the eddy insert surface determines in this connection which of the partial streams is transferred primarily into the adjacent partial stream.

The eddy insert surfaces of the invention can be used in cooling towers whose cooling air flows substantially in one direction, as is true for instance in cellular-type coolers of rectangular base surface whose cooling air is aspirated approximately horizontally on opposite sides and discharged jointly vertically upwards. In this case it is possible to arrange one or more eddy insert surfaces alongside of each other. On the other hand, in the case of cooling towers in which the cooling air is aspirated on the entire circumference of their polygonal or circular base surface, a plurality of eddy insert surfaces are arranged uniformly distributed over the circumference, the eddy insert surfaces being at an obtuse angle with respect to each other.

In accordance with another feature of the invention, the angle of attack of the eddy insert surface with respect to the direction of flow is between 10° and 50°; and preferably about 30°. The width-length ratio of the eddy insert surface in accordance with the invention is between 1:1 and 1:3, and preferably 1:1.8.

Experiments have furthermore shown that the width of the eddy insert surface or the sum of the widths of all eddy insert surfaces should correspond to 40% to 90% (preferably 65%) of the transverse extent of the flow in the approach-flow plane of the eddy insert surface(s). These values guarantee a good action even with low velocities of flow, without undesirably large flow losses being caused thereby since only the projection of the eddy insert surfaces arranged at an angle with respect to the direction of flow is controlling for the reduction of the cross section of flow and the eddying is obtained by the course of the edge of the eddy insert surfaces.

In accordance with further features of the invention, the eddy insert surface can be profiled other than planar or V-shaped in cross section and/or be provided with an angularly bent edge so that the eddy insert surfaces of the invention can be formed both as a hollow body from two half shells and in the case of a flat development and despite a thin thickness of material, be stabilized by corresponding cross sectional shaping other than planar.

In accordance with the invention, the eddy insert surfaces can be made adjustable in their position in the cooling tower or in their angle of attack with respect to the flow so that, if necessary, adaptation both of the position and of the angle of attack to the varying operating conditions is possible.

The eddy insert surfaces which have been described above with respect to their construction in accordance with the invention and their action, when they are used on a cooling tower with natural draft and/or forced ventilation and with heat exchange means arranged between a cooling air inlet and a cooling air outlet are arranged in accordance with the invention downstream of the heat exchange means as seen in the direction of flow of the cooling air. When employed on stacks or pipeline systems in which at least one individual stream is fed, to a main stream or for the mixing of at least two individual partial streams, they are arranged in the boundary zone of the individual streams and/or directly in the inlet opening of each individual stream.

With the above and other objects and advantages in view, the present invention will become more clearly understood in connection with the detailed description of preferred embodiments, when considered with the accompanying drawings, of which:

FIG. 4 is a vertical section through a natural-draft dry cooling tower having a plurality of eddy insert surfaces;

FIGS. 5 to 8 are top views of four different basic shapes of the eddy insert surface;

FIGS. 9 and 10 are each a cross section through an eddy insert surface;

FIGS. 11 and 12 are diagrammatic side views of a stack with two individual streams discharging at an angle into the stack and of an eddy insert surface arranged in the boundary zone;

FIGS. 13 and 14 are diagrammatic side views of a stack with two individual streams entering parallel to each other, with eddy insert surfaces arranged directly in each inlet opening;

FIGS. 15 and 16 are a top view and a side view of a pipeline system with the feeding of an individual stream to a main stream and with eddy insert surfaces arranged both directly in the inlet opening and also in the boundary zone.

Figure 2:
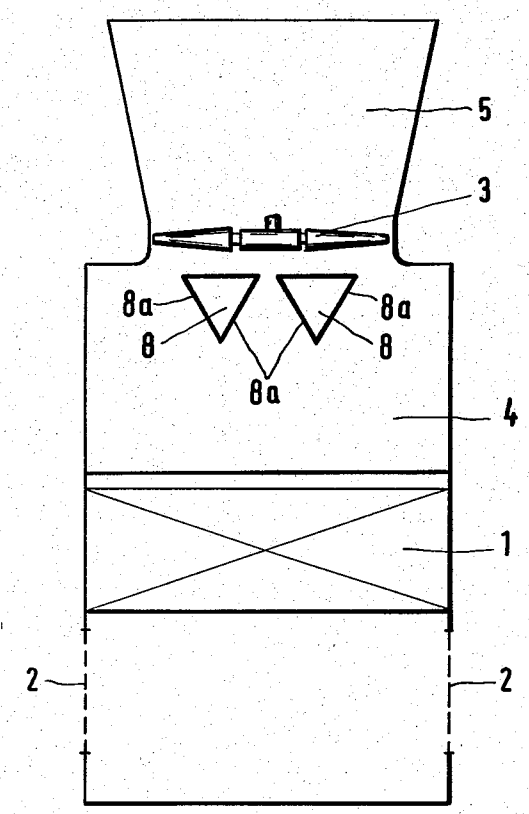
FIG. 2 is a longitudinal section through the cooling tower, viewed 90° away from the sectional view shown in FIG. 1.

Referring to FIGS. 1 to 4, the arrangement and effect of the eddy insert surface in cooling towers will now be described. Thereafter the eddy insert surface in the case of stacks and pipeline systems will be described. In conclusion the variations possible for all cases will be set forth.

The eddy insert surface means and is a "surface-type" insert element, which is thin between its surfaces and thin relative to its other dimensions approximating a two-dimensional surface having a free upstream edge. This edge is spaced apart (thus being free) from the walls of the flow means (e.g. stacks, cooling towers, pipelines, and the like) so that the flow can break away over the free upstream edge into eddies and flow around the surfaces of the element.

The wet-dry cooling tower shown in FIGS. 1 and 2 also known as a hybrid cellular-type cooler, is provided on its entire square base surface with a heat exchange device 1 in which a direct heat exchange takes place between the water to be cooled and the cooling air which enters through a cooling air inlet 2 below the heat exchange device 1. The cooling air, which enters either on two opposite sides or over the entire circumference of the cellular-type cooler, flows through the heat exchange device 1, also designated as wet cooling, approximately vertically and thus in opposite direction to the water films trickling down on the inserts of the heat exchange device 1. The heated cooling air which has become moist is drawn off by a fan 3 which is located above a mixing space 4 in the lower part of a diffuser 5.

On two opposite sides of the mixing space 4, each within the region of another cooling air inlet 6, there are arranged heat exchange devices 7 for indirect exchange of heat. These heat exchange devices 7, referred to as dry coolers, comprise preferably a plurality of pipes which extend parallel to each other and are possibly ribbed. These pipe bundles are flowed through, transversely to the direction of flow of the water contained in the pipes, by the cooling air, which is also drawn in through the cooling air inlets 6 by the fan 3. The streams of cooling air which enter into the mixing space 4 through the heat exchange devices 7 are thus mixed in the mixing space 4 with the stream of cooling air which comes vertically from below out of the heat exchange device 1.

Figure 1:
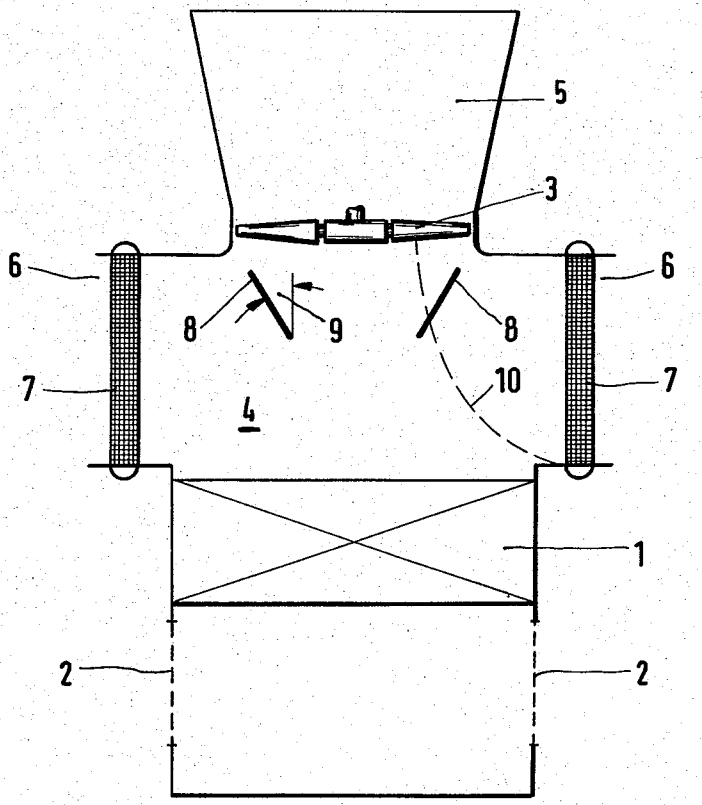
FIG. 1 is a vertical section through a forced-ventilation wet-dry cellular-type cooler with two eddy insert surfaces.

In the region where the different streams of cooling air meet each other, there are arranged, near boundary-flow surfaces 10 (only one being indicated in the drawing) in the mixing chamber 4 of the embodiment of FIGS. 1 and 2, respectively two eddy insert surfaces 8 which are arranged at an acute angle 9 to the direction of flow of the cooling air. The boundary flow surface 10 between the different streams of air which meet each other is indicated in dashed line in the right-side of FIG. 1.

The embodiment in accordance with FIGS. 1 and 2 shows that the course of the edge of the eddy insert surfaces 8 formed in the shape of a delta has both a component extending in the direction of flow of the cooling air and a component extending transverse thereto and that the surface is at an acute angle 9 with respect to the direction of flow of the cooling air. The edges 8*a* of the eddy insert elements 8 produce, as a result of the flow of the cooling air against them, in each case an eddy field which spreads out in circular conical shape downstream. Each eddy field, due to its rotation, forms a component of flow transverse to the direction of the main flow of the cooling air, which, due to the exchange of momentum inherent therein, produces, transverse to the direction of flow, a good mixing of the different streams of cooling air.

The dry cooling air which has been heated in the heat exchange devices 7 is in this way mixed well with the moist hot air coming from the heat exchange device 1 so that even with a high moisture content of this hot air the formation of vapors is avoided at the cooling air outlet of the diffuser 5.

Within a cell-type cooler 12 (FIG. 3) to which the cooling air flows only from one side of its rectangular cross section through a heat exchange device 13 which can be formed as trickle inlet for direct heat exchange, the eddy insert surface 11 of the invention serves to mix cold air streams of different physical parameters. The same effect is obtained if the heat exchange device 13 is formed as tubular heat exchanger for indirect heat exchange.

Figure 3:
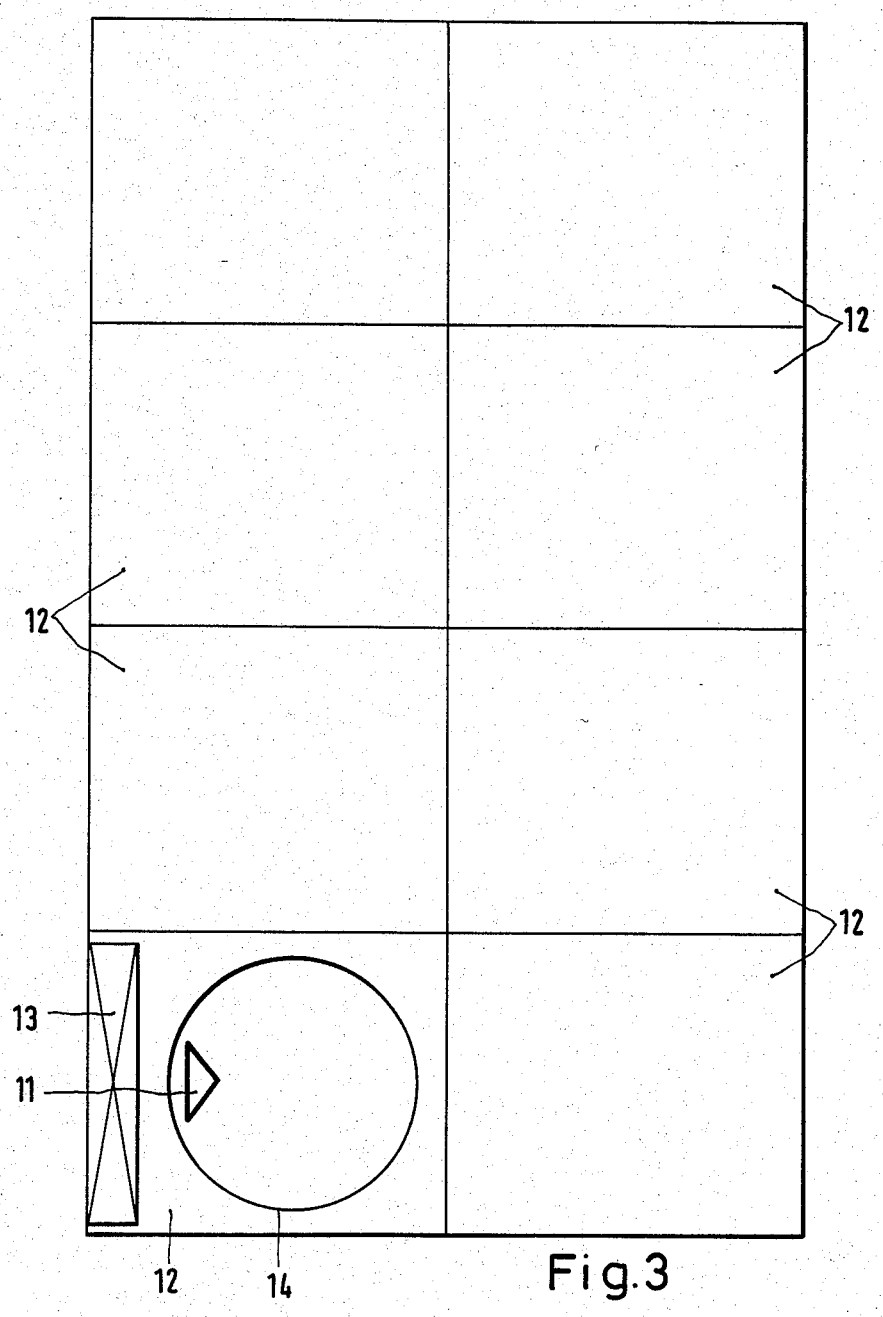
FIG. 3 is a top view of a cooling plant comprising eight cellular-type coolers with unilateral air inlet and in each case one eddy insert surface.

In the embodiment of FIG. 3, in which the entire cooling plant comprises of eight identical cellular type coolers 12, the eddy insert surface 11 serves to produce eddy fields which, by their rotation, form a component of flow transverse to the main direction of flow of the cooling air and, as a result of the exchange of momentum inherent therein, transverse to the direction of flow, avoids a moving of the flow away from the wall of the cooling tower. The stabilization of the flow inherent therein not only results in a uniform emergence of cooling air from the entire surface of the diffuser 14 indicated in the lower left half of FIG. 3 but, due to the stabilization of the flow, avoids reductions in output, such as occur, for instance, due to irregularities in the profiles of the physical variables of the stream of cooling air and surges of cooling air related therewith.

On basis of the circumstances described above the arrangement of eddy insert surfaces 15 (FIG. 4) within a cooling tower shell 16 of a dry cooling tower operated with natural draft is also advantageous since these eddy insert surfaces 15 which are arranged above the heat exchange devices 17, due to the resultant mixing of the heated cooling air make the profiles of the physical variables of the heated stream of cooling air uniform and thereby produce uniform draft conditions over the cross section of the cooling tower. This is true not only of the hyperbolic cooling tower shell shown by way of example but of cooling towers of any desired contour.

The diagrammatic side views of a stack in accordance with FIGS. 11 and 12, the side view of which shown in FIG. 12 is turned 90° from the side view shown in FIG. 11, shows two individual streams $Q_1$ and $Q_2$ discharging at an angle in the stack 24. While the connecting pipe 25 of the individual stream $Q_1$ discharges at right angles to the longitudinal axis of the stack 24, the connecting pipe 26 of the individual stream $Q_2$ is connected obliquely. Approximately in the boundary zone of the meeting individual streams $Q_1$ and $Q_2$ there is arranged a delta-shaped eddy insert surface 27 which assures a low-loss but intensive mixing of the two individual streams $Q_1$ and Q2 over a short distance of flow.

The embodiment of FIGS. 13 and 14 again shows a stack 28 to which two individual streams $Q_1$ and $Q_2$ are fed. In this case, the feeding of the two individual streams $Q_1$ and $Q_2$ takes place through connecting pipes 29 which extend parallel to each other and in the direction of the longitudinal axis of the stack 28. In this embodiment each case one delta-shaped eddy insert surface 30 is arranged directly in the inlet opening of each individual stream $Q_1$ and $Q_2$. These eddy insert surfaces 30 also assure a good mixing of the individual streams $Q_1$ and $Q_2$ over a short mixing path and with low losses.

FIGS. 15 and 16 show a pipeline system consisting of a main pipe 31 and a connecting pipe 32 which extends at right angles to the main pipe 31. The individual stream $Q_2$ fed through the connecting pipe 32 to the main stream $Q_1$ is mixed by eddy insert surfaces 33 and 34 intensively with the main stream $Q_1$, the eddy insert surface 33 being arranged directly in the inlet opening of the connecting pipe 32 and the eddy insert surface 34 being arranged in the boundary zone between the individual streams $Q_1$ and $Q_2$ which are to be mixed.

While in FIGS. 1 to 4 and 11 to 16 delta-shaped eddy insert surfaces of triangular basic shape are shown, FIGS. 5 to 7 show other possible developments. FIG. 5 shows a circular insert surface 18, FIG. 6 an elliptical eddy insert surface 19 and FIG. 7 a parabolic eddy insert surface 20. Also the curved edges of these eddy insert surfaces 18, 19 and 20 have a symmetrical course with plane of symmetry extending in the direction of flow of the cooling air. This also applies to the diamond base shape of the eddy insert surface 21 of FIG. 1.

FIGS. 9 and 10 finally show that the eddy insert surfaces 22 and 23 can be profiled other than planar in cross section. The eddy insert surface 22 of FIG. 9 is, for instance, developed in V-shaped cross section. The eddy insert surface 23 is provided with bent edges 23*a*.

The angle of attack 9, which can be noted in particular in FIG. 1, of the eddy insert surface 8 with respect to the direction of flow of the cooling air can be between 10° and 50°. A particularly good effect is obtained with an angle of about 30°. The ratio of the width to the length of the eddy insert surfaces 8, 11, 15 and 18 to 23 can be between 1:1 and 1:3. A particularly good eddy formation and at the same time a particularly low pressure loss result when the width-length ratio has a value of 1:1.8.

Since the degree of blocking by the eddy insert surfaces results only by the projection, dependent on the angle of attack, of the eddy insert surfaces into the direction of flow, the width of the eddy insert surface or the sum of the widths of all eddy insert surfaces can lie between 40% and 90% of the transverse extent of the flow in the plane of attack of the eddy insert surface or surfaces. An optimum effect is obtained when this value is about 65%. The eddy insert surfaces 8, 11 and 15 shown in FIGS. 1 to 4 can be developed adjustable with respect to their position in the cooling tower and/or with respect to their angle of attack 9 with reference to the flow, in such a manner that their action, i.e. the size and extent of the eddy field produced by their edges, can be varied.

Such changes can be effected upon the placing in operation of the cooling towers in order by measurements to obtain an optimum position and angle of attack of the eddy insert surfaces. Furthermore, it is possible to develop the eddy insert surfaces so that they are adjustable during operation of the cooling tower in order to adapt their action to the varying operating conditions.

The eddy insert surfaces described above can also be introduced subsequently into existing cooling towers, stacks and pipelines so that their advantageous effects can be utilized not only in the case of new structures.

The word "streams" is herein defined to include several individual streams as well as a single stream having different characteristics of state (parameters) at different regions of flow and in this respect is composed of different flow streams.

I claim:

1. In a gas flow system having at least one gas flow means capable of conducting streams of gas flow therethrough and defining a main direction of flow of at least one of the streams, the improvement comprising means for mixing said streams of the gas flow in the gas flow means, said mixing means comprises at least one element arranged in said at least one of said streams, said element is a substantially, delta-shaped flat plate having planar surfaces and a sharp and free upstream V-shaped edge defining an upstream vertex and two portions of said edge on respective sides of said vertex, each of said two portions defining a sharp edge in cross-section, said surfaces of said plate being oriented inclined at an acute angle relative to said main direction of flow of said one stream, said two portions of said edge extending transversely inclined to said main direction of flow of said one stream, wherein said two portions of said edge therefrom within a flow cross section of said one stream initiating two continuous conically widening oppositely rotating vortexes from each of said two portions of the edge, respectively, the vortexes travelling from the respective portions downstream and inclined relative to said main direction of flow while widening conically including transversely to the main direction of flow of said one stream, extending into the flow cross section of another of the streams, and effecting, substantially exclusively via said vortexes, mixing of said one stream with said another of the streams.

2. The system according to claim 1, wherein said two portions of said edge of said element define a line of symmetry extending substantially in the main direction of the flow.

3. The system according to claim 1, wherein said element is disposed in said gas flow means adjustable with respect to its position.

4. The system according to claim 1, wherein said element is disposed in said gas flow means adjustable with respect to the angle of said element relative to the main direction of the flow.

5. The system according to claim 1, wherein said gas flow means constitutes a cooling tower with natural draft and/or forced ventilation, said cooling tower has a cool-air inlet and an air outlet, heat exchangers are arranged between said cool-air inlet and said air outlet of said cooling tower, said gas flow being a flow of cooling air, said at least one element is arranged downstream of the heat exchangers with respect to the direction of flow of the cooling air through said cooling tower.

6. The system according to claim 1, wherein said gas flow means comprises a stack and at least two conduits each communicating with said stack for feed of at least two individual of said streams of the gas flow in said at least two conduits, respectively, into said stack defining a boundary flow area between said gas flow streams, said at least one element is arranged in the boundary flow area of said gas flow streams.

7. The system according to claim 1, wherein said gas flow means comprises a pipeline system having a main pipe with said one stream forming a main flow therein and at least one conduit communicating with the main pipe for feed of at least one of said another streams of gas flow in one of said conduits into said main flow in said main pipe defining a boundary flow area between the main flow and the at least one another stream in said main pipe, said at least one element is arranged in the boundary flow area in said main pipe.

8. The system according to claim 1, wherein said gas flow means comprises a stack and at least two conduits each communicating with said stack via inlet openings, respectively, of said at least two conduits, for mixing at least two of said streams of gas flow in said conduits, respectively, entering said stack from respective of said inlet openings, said at least one element comprises at least two of said elements, said elements are arranged directly in the inlet opening of each of said at least two conduits, respectively.

9. The system according to claim 1, wherein said gas flow means comprises a pipeline system having a main pipe with said one stream forming a main flow therein and at least one conduit communicating via a respective inlet opening thereof with the main pipe for mixing of at least one of said another streams of gas flow in one of said conduits with said main flow in said main pipe via said inlet opening, respectively, of said at least one conduit, said at least one element is arranged directly in the inlet opening of each of the at least one conduit, respectively.

10. The system according to claim 1, wherein the largest dimension of said element is substantially small relative the cross section dimensions of said gas flow means.

11. The device according to claim 1, wherein said gas flow means comprises a continuous main conduit constituting a feed conduit for said one stream and having laterally connected thereto via a discharge opening at least one feed conduit for at least one of the another of the streams, said element is arranged in said main conduit in a vicinity of the discharge opening of said at least one feed conduit and extends into the flow cross section of all said streams.

12. The device according to claim 1, wherein said gas flow means comprises a continuous main conduit constituting a feed conduit for said one stream and having laterally connected thereto via a discharge opening at least one feed conduit for at least one of the another of the streams, one of said at least one element is arranged in each flow cross section of each of said feed conduits.

13. The device according to claim 1 wherein said gas flow means comprises a continuous main conduit constituting a feed conduit for said one stream having laterally connected thereto via a respective discharge opening at least one feed conduit for at least one of the another of the streams, said at least one element is arranged in the main conduit downstream of said respective discharge opening of said at least one feed conduit.

14. The device according to claim 1 wherein said gas flow means comprises a plurality of feed conduits which discharge parallel to each other via respective discharge openings within a common main conduit, said at least one element is arranged respectively in a vicinity of the discharge opening of each of said feed conduits.

15. In a device for mixing at least two individual gas flow streams, the individual streams each defining a flow cross section and a main direction of flow and discharging into each other via at least one opening, the streams defining a boundary flow surface where they meet, and at least one element arranged in the flow cross section of a corresponding of the individual streams, the improvement wherein the element is a substantially, delta-shaped flat plate having planar surfaces and a sharp and free upstream V-shaped edge defining an upstream vertex and two portions of said edge on respective sides of said vertex, each of said two portions defining a sharp edge in cross-section, said surfaces of said plate being oriented inclined at an acute angle relative to said main direction of flow of the corresponding individual stream, said two portions of said edge extending transversely inclined to said main direction of flow of the corresponding individual stream and positioned in the boundary flow surface, wherein said two portions of said edge within the flow cross section of said corresponding individual stream initiating two continuous conically widening oppositely rotating vortexes from each of said two portions of the edge, respectively, the vortexes travelling from the respective portions downstream and inclined relative to said main direction of flow while widening conically including transversely to the main direction of flow of said corresponding individual stream, extending into the flow cross section of another of the individual streams, and effecting, substantially exclusively via said vortexes, mixing of said corresponding individual stream with said another of the individual streams.

* * * * *